US006806596B2

(12) United States Patent
Feyerl et al.

(10) Patent No.: US 6,806,596 B2
(45) Date of Patent: Oct. 19, 2004

(54) ARMATURE FOR AN ELECTROMAGNETIC ACTUATOR WITH A SINTERED ARMATURE PLATE

(75) Inventors: Günter Feyerl, Alsdorf (DE); Lutz Fischer, Simmerath (DE); Michael Schebitz, Eschweiler (DE)

(73) Assignee: Fev Motorentechnik GmbH, Aachen (DE)

( * ) Notice: Subject to any disclaimer, the term of this patent is extended or adjusted under 35 U.S.C. 154(b) by 0 days.

(21) Appl. No.: 10/334,150

(22) Filed: Dec. 31, 2002

(65) Prior Publication Data

US 2003/0205940 A1 Nov. 6, 2003

Related U.S. Application Data

(63) Continuation of application No. PCT/EP02/04126, filed on Apr. 13, 2002.

(30) Foreign Application Priority Data

May 3, 2001 (DE) ..... 101 21 492

(51) Int. Cl.[7] ..... H01F 7/16
(52) U.S. Cl. ..... 310/28; 335/261
(58) Field of Search ..... 310/12, 15, 17, 310/28; 335/255, 261, 262

(56) References Cited

U.S. PATENT DOCUMENTS 3,670,223 A * 6/1972 Pommeret ..... 318/124
6,242,840 B1 * 6/2001 Denk et al. ..... 310/254

FOREIGN PATENT DOCUMENTS

DE 198 07 181 A 8/1999
DE 199 04 634 A 8/2000

OTHER PUBLICATIONS

Translation of German Patent No. 199 04 634 A1, Aug. 10, 2000, Holger Lange.*

* cited by examiner

*Primary Examiner*—Thanh Lam
*Assistant Examiner*—Judson H. Jones
(74) *Attorney, Agent, or Firm*—Venable LLP; Catherine M. Voorhees

(57) ABSTRACT

The invention relates to an armature for an electromagnetic actuator, having a guide pin that is connected to an armature plate, characterized in that the armature plate (3) is formed by a frame element (4) that comprises soft-magnetic iron and is connected to the guide pin (2), and at least one plate element (5) that comprises a soft-magnetic material and is held in the frame element (4).

6 Claims, 3 Drawing Sheets

ARMATURE FOR AN ELECTROMAGNETIC ACTUATOR WITH A SINTERED ARMATURE PLATE

This application is a continuation of PCT/EP02/04126 filed on Apr. 13, 2002.

BACKGROUND OF THE INVENTION

For numerous applications, an electromagnetic actuator is embodied by at least one electromagnet that can be supplied with current, and whose pole face has an associated armature that is spaced from it and held in a first switching position by a restoring spring. When the electromagnet is supplied with current, the armature is brought into contact with the pole face of the electromagnet, counter to the force of the restoring spring. When the current to the electromagnet is cut off, the restoring force of the restoring spring returns the armature to the first switching position. The control element to be actuated is connected to the armature, so the armature simultaneously constitutes a component of the control element.

Also known are electromagnetic actuators that have two electromagnets whose pole faces are oriented toward one another, and are spaced from one another, and in which the armature, which is connected to the control element, moves back and forth between the electromagnets, counter to the force of restoring springs, when the electromagnets are correspondingly supplied with current. Actuators of this type are used, for example, to actuate cylinder valves in piston-type internal-combustion engines. In this instance, in the first switching position, the armature is employed in holding the cylinder valve closed with one of the two electromagnets, and after the retaining current has been cut off and the capturing current has been initiated at the other electromagnet, the armature assists in keeping the cylinder valve in the open position. This means that a cylinder valve in, for example, a four-stroke, piston-type internal-combustion engine is actuated as a function of the crankshaft rpm with a very high switching frequency. Because the very short switching times must be precisely maintained, despite the high switching frequency, it is significant that the armature be embodied with a low tendency toward eddy-current formation, so it can release quickly from the pole face when the retaining current is shut off, for example.

Because the armature plate must have soft-magnetic properties, but is connected to a guide pin that must be wear-resistant and, accordingly, should preferably be produced from a heat-treatable steel material, it is not possible to produce the armature, that is, the armature plate and the guide pin, from only a single material when optimal results are required. With this in mind, it has been proposed to connect an armature plate comprising a plurality of sheets to a steel guide pin in order to utilize the known low eddy-current formation of laminated yoke bodies of transformers or electromagnets in such laminated yoke bodies. An associated problem is the high mechanical stress on the armature plate that occurs upon impact with the pole face of an electromagnet.

SUMMARY OF THE INVENTION

It is the object of the invention to create an armature that has a low tendency to form eddy currents, and satisfies both the mechanical and electrical requirements.

According to the invention, this object is accomplished by an armature having the features disclosed in claim 1. The frame element permits a secure connection to the guide pin, on the one hand, and, in connection with the employed plate element, permits the armature to withstand high structurally dynamic stress over a lengthy period of time.

In a first embodiment of the invention, the plate element comprises a sintered metallurgic powder containing a soft-magnetic material.

It is advantageous to use a powder that can be sintered, and in which particles comprising soft-magnetic material remain extensively electrically insulated from one another, despite the sintering process. This can be effected by adding powdered components that can be sintered and are electrically non-conductive, but preferably by using powders in which the ferromagnetic or soft-magnetic and/or electrically conductive powder particles are provided with an "envelope" of electrically non-conductive materials that can be sintered. Thus, when the armature plate has been completely sintered, the incidence of eddy currents is lower than with a purely soft-magnetic metal. It is therefore possible to produce a solid armature plate that, if having a corresponding composition of sintering powder, exhibits only a slight tendency toward eddy-current formation during magnetic reversal.

In a second embodiment, the plate element comprises punch-bundled, adjacent sheet-steel strips that are advantageously produced from a thin transformer sheet.

The armature according to the invention, having a sintered plate element, offers yet another manufacturing-related advantage. The raw part, that is, the guide pin with the frame element and the sintered-in plate element, is cooled rapidly from the sintering temperature down to ambient temperature, then reheated to the heat-treatment temperature of the steel material of the guide pin, maintained at this temperature for a specified period of time and then completely cooled. This method capitalizes on the fact that the sintering temperature for the sintering powders considered here is significantly higher than the hardening and tempering temperature for a heat-treatable material, so after the sintering process has been completed, the further heat treatment can practically be effected in a heated state. During the subsequent heat treatment, the manipulation of the temperature in the heating process can take into account the structural changes in the heat-treatable steel material, without negatively influencing the structure of the sintered armature plate. For example, depending on the type of heat-treatable steel material, it can be advantageous to heat the material in stages, and maintain the temperature at a predetermined level during an intermediate temperature stage, in order to allow the material to form its structure properly.

In an advantageous embodiment of the invention, it is provided that the frame element has a sleeve-like center part, which is connected to the guide pin, preferably through hard-soldering, after the plate element has been incorporated into the frame element, whether through sintering or soldering in the case of a punch-bundled plate element. Thus, in addition to providing a highly stable connection between the armature plate and the guide pin, it is also possible to select a soft-magnetic or non-magnetizable, and/or poorly electrically conductive material having appropriate stability and conductivity properties for the frame element with its sleeve-like center part. Therefore, only the "bare" guide pin comprises a heat-treatable steel material and thus "hard-magnetic" material. This makes the conditions unfavorable for the formation of eddy currents in the armature plate via the frame element, which would be the case in material-to-material bonding with the guide pin comprising a hard-magnetic material. This attains the desired reduction in the eddy-current formation.

BRIEF DESCRIPTION OF THE DRAWINGS

The invention is described in detail below in conjunction with schematic drawings of exemplary embodiments. Shown are in.

DETAILED DESCRIPTION OF THE PREFERRED EMBODIMENTS

Figure 1:
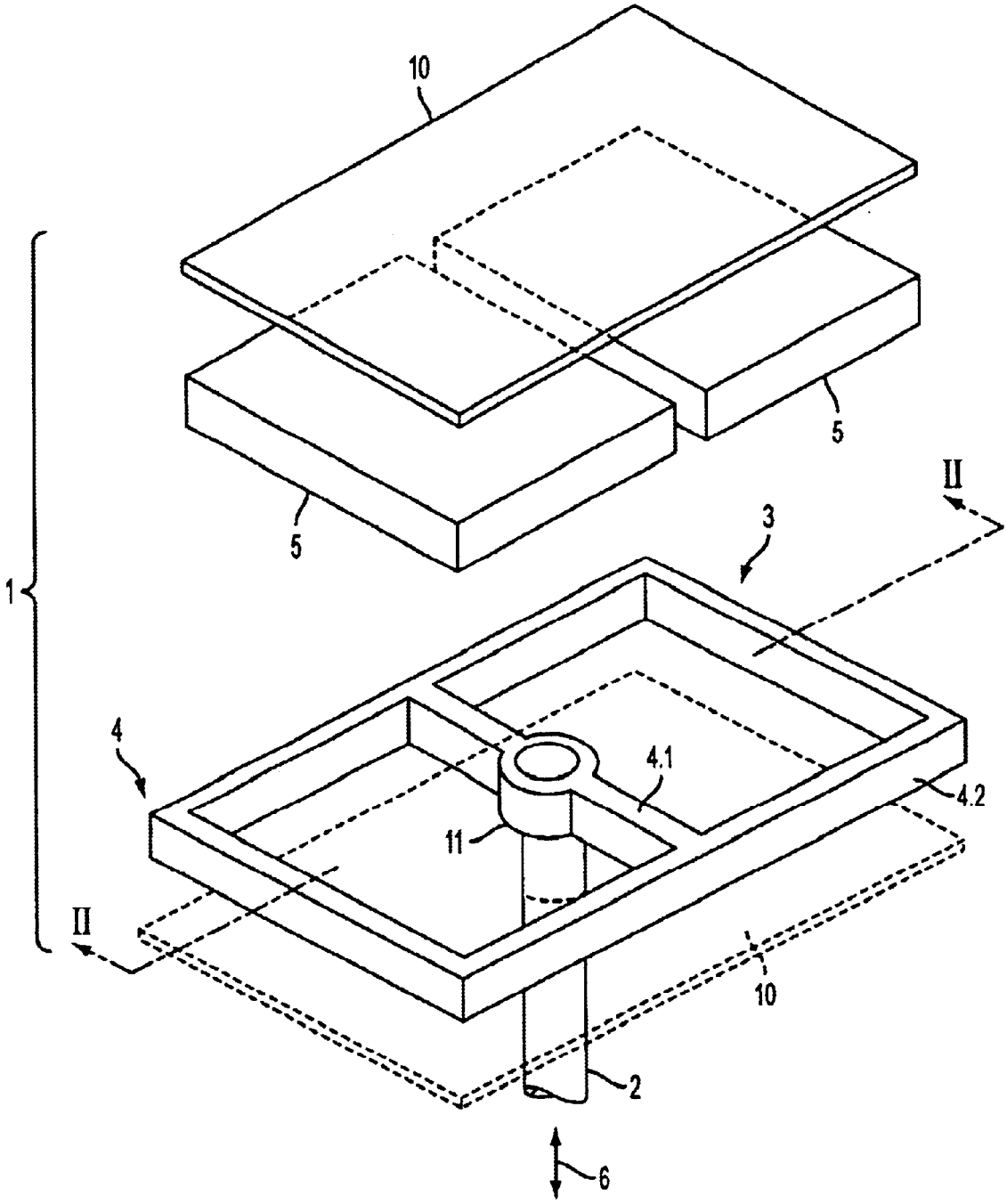
FIG. 1 an exploded representation of an armature for an electromagnetic actuator that effects a back-and-forth movement.

The perspective, exploded representation in FIG. 1 shows an armature 1, which essentially comprises a guide pin 2 and an armature plate 3. The armature plate 3 has a frame element 4, which is permanently connected to the guide pin 2 and is filled with plate elements 5 made of a ferromagnetic sintering material. The armature 1 is used in an actuator in which the electromagnets are disposed with their pole faces parallel to the armature plate 3, and a back-and-forth movement is effected in the direction of the longitudinal axis of the guide pin 2 (arrows 6).

As can be seen from FIG. 1, the guide pin 2 is connected by one end to the frame element 4, which has a transverse bridge 4.1 and a circumferential edge frame 4.2 that is connected to the transverse bridge 4.1. The frame element 4 surrounds the two sintered plate elements 5 with a form-fit.

In the process of producing an armature of this type, first a raw part is constructed. The sinterable powder, which contains ferromagnetic, preferably soft-magnetic, material, is pressed as a so-called green compact into the frame element 4 connected to the guide pin 2. The pressing process lends the armature plate its desired density; at the edges, the powder creates a form-fit with the edge frames and the transverse bridge 4.1 on the inside surfaces 8 of the edge frame 4.2 and/or the transverse bridge, the sides having depressions and/or protrusions 7. All of the edges and transitions that are surrounded by the material of the plate elements 5 must be considerably rounded to avoid notch effects that could cause the armature to crack under mechanical stress.

The raw part produced in this manner is subsequently heated to the sintering temperature, and cooled again after the plate elements 5 have been completely sintered. The raw part can either be cooled completely or heated, "in a heated state," at least one more time to the heat-treatment temperature of the steel material used for the guide pin 2, and maintained at this temperature for a predetermined length of time, and then cooled completely. Because the heat-treatment temperature for the steel material is significantly lower than the sintering temperature for the material of the plate elements 5, this heating does not adversely affect the material of the plate elements 5.

Figure 2:
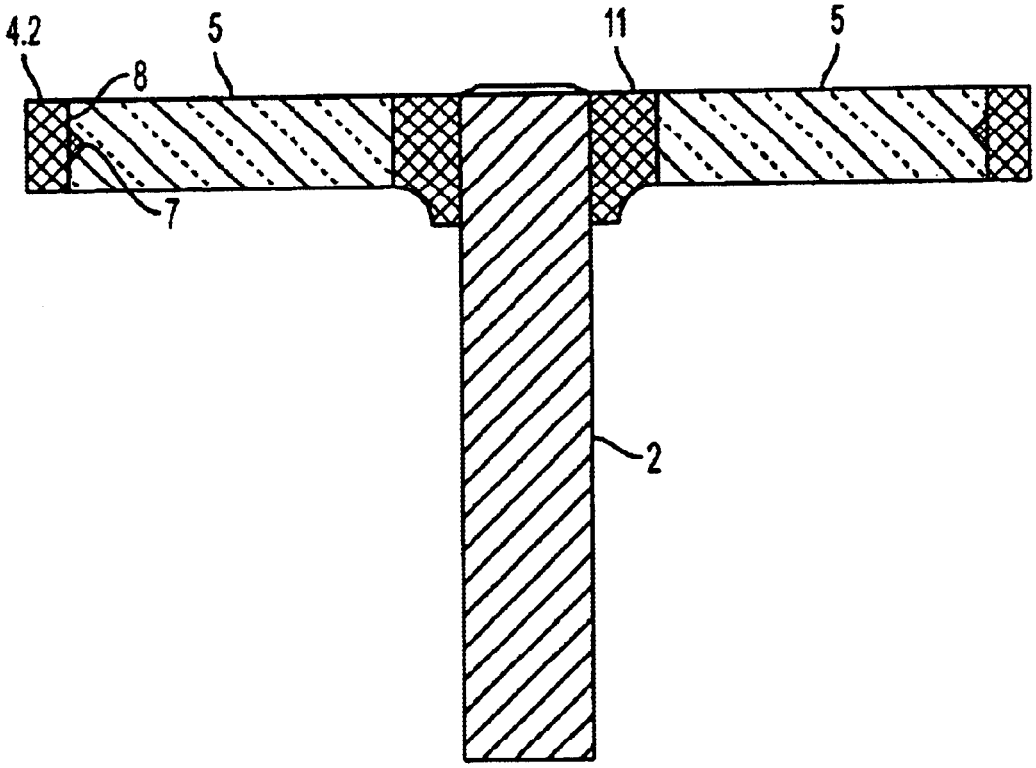
FIG. 2 an axial section through the armature along the line II—II in FIG. 1.

FIGS. 1 and 2 illustrate an armature having a rectangular armature plate. In a plurality of applications, however, actuators are used with armatures that possess a square or circular contour. In these embodiments, the contour of the frame element 4 is also adapted appropriately to the outside contour of the armature plate.

The surfaces of the armature plate that are oriented perpendicular to the direction of movement (arrow 6) are advantageously covered with thin cover plates 10 comprising soft-magnetic material. These cover plates 10 may be glued or soldered to the material of the armature plate.

It can be seen in FIG. 2 that the frame element 4 is not in a material-to-material connection with the guide pin 2, but has a sleeve-like center part 11. The frame element 3 [sic] and its sleeve-like center part 11 are produced in one piece and pressed with the sintering material of the plate elements 5 in the method described in connection with FIG. 1, and then completely sintered.

The obtained armature plate, which extensively comprises a material that prevents the formation of eddy currents during remagnetization, is subsequently connected, for example hard-soldered, to the guide pin 2.

Figure 3:
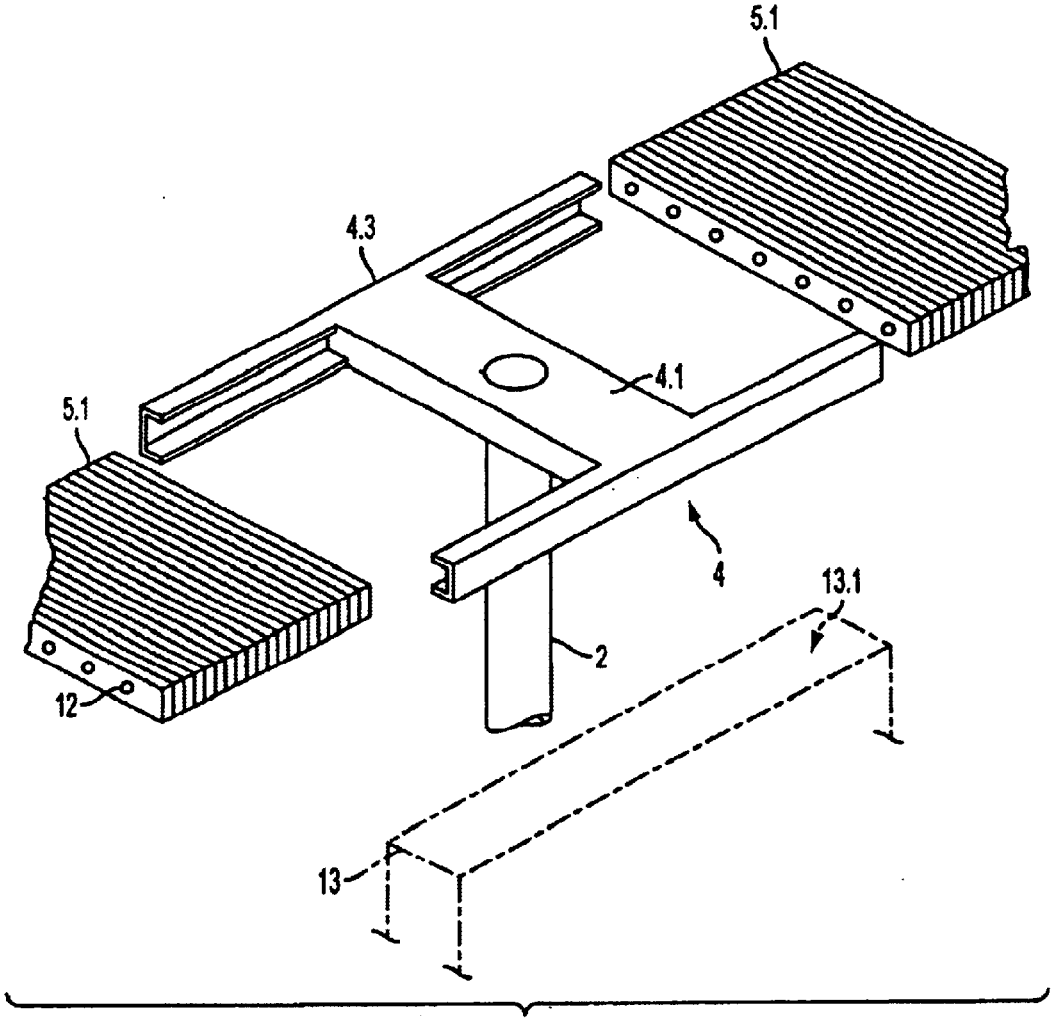
FIG. 3 a modification of the embodiment according to FIG. 1.

FIG. 3 is a perspective representation, again in exploded form, of a modified embodiment. In this embodiment, a frame element 4 is again provided on the guide pin 2, and has a transverse bridge 4.1, to which a frame element 4.3 is connected. In the illustrated embodiment, the frame element essentially comprises two parallel U-profiles, which are disposed at the free end of the transverse bridge 4.1. Plate elements 5.1 can be inserted into the U-profiles of the frame element 4.3; here, the plate elements comprise a plurality of punch-bundled, adjacent, thin sheet-steel strips, preferably so-called transformer sheets. The punch-bundling produces raised areas 12 in the superposed steel strips, which allow the individual strips to be connected to one another through friction and a form-fit.

The flat, adjacent individual steel sheets of the plate elements 5.1, that is, the ones that are oriented perpendicular to the plane of the plate and are secured to one another through the punch-bundling, extend in the direction of the magnetic flux. This leads to an improvement in the magnetodynamic properties with respect to eddy-current behavior and the development of magnetic forces, and thus to a better operating behavior with an optimized energy requirement and a sufficiently high structurally dynamic load capacity due to the selected overall construction. The frame element 4 is also produced from soft-magnetic pure iron, and is soldered or connected in another permanent manner to the guide pin comprising wear-resistant steel.

To prevent the plate elements 5.1 from falling out, either the elements are soldered longitudinally along the edge frames 4.3 of the frame element 4, or a stop element, such as a stop sheet, is soldered to the free ends of the U-profile, or bent to form a corresponding stop.

In FIG. 3, a pole leg 13 of a yoke body of an electromagnet is indicated. At least a second pole leg is disposed to extend parallel to the first, so when current is supplied, the armature plate rests with the region of the frame elements 4.3 on the pole face 13.1. Often, even a third pole leg is disposed between the two pole legs, the leg having a bore in which the guide pin 2 is seated to be displaced.

In both embodiments, the transverse bridges 4.1 extend in the direction of the magnetic flux between the pole legs 13.

In the embodiment according to FIG. 3, the sheet strips likewise extend in the direction of the magnetic flux; here, the formation of eddy currents is greatly reduced by the fact that the individual sheet strips stand upright with respect to the plane of the plate.

In the embodiment according to FIG. 3, instead of the punch-bundled plate elements 5.1, plate elements of the above-described type that have been completely sintered can be inserted and fixedly connected to the frame element 4.

In the embodiment according to FIG. 1, an additional transverse bridge can be provided perpendicular to the transverse bridge 4.

What is claimed is:

1. An armature for an electromagnetic actuator, having a guide pin that is connected to an armature plate, characterized in that the armature plate (3) is formed by a frame element (4) that comprises soft-magnetic iron and is connected to the guide pin (2), and at least one plate element (5) that comprises a soft-magnetic material and is held in the frame element (4), and the frame element (4) has at least one transverse bridge (4.1) that is oriented essentially radially with respect to the guide pin (2), and is connected at its ends to edge frame (4.2).

2. The armature according to claim 1, characterized in that the transverse bridge (3.2) has a rectangular cross-section whose long edge extends perpendicular to the plane of the armature plate (3).

3. The armature according to claim 1, characterized in that the edge frame (4.2) has a rectangular cross-section whose long edge extends pependicular to the plane of the armature plate (3).

4. An armature for an electromagnetic actuator, having a guide pin that is connected to an armature plate, characterized in that the armature plate (3) is formed by a frame element (4) that comprises soft-magnetic iron and is connected to the guide pin (2), and at least one plate element (5) that comprises a soft-magnetic material and is held in the frame element (4), the frame element has a transverse bridge connected at its ends to an edge frame, and the transverse bridge (4.1) and/or the edge frame (4.2) has or have projections or depressions (7) on the inside surfaces for creating a form-fit for the plate element (5).

5. An armature for an electromagnetic actuator, having a guide pin that is connected to an armature plate, characterized in that the armature plate (3) is formed by a frame element (4) that comprises soft-magnetic iron and is connected to the guide pin (2), and at least one plate element (5) that comprises a soft-magnetic material and is held in the frame element (4), the plate element (5) is sintered from a metallurgic powder containing a soft-magnetic material, and the metallurgic powder is pressed into the frame element (4) and then sintered.

6. An armature for an electromagnetic actuator, having a guide pin that is connected to an armature plate, characterized in that the armature plate (3) is formed by a frame element (4) that comprises soft-magnetic iron and is connected to the guide pin (2), and at least one plate element (5) that comprises a soft-magnetic material and is held in the frame element (4), the plate element (5) is formed from punch-bundled, adjacent sheet-steel strips that stand upright with respect to the plane of the plate, the armature has an edge frame, and the edge frame (4.3) is embodied as an angled profile, wherein the angled profile is a U-profile.

* * * * *